United States Patent [19]

Garfinkle

[11] 4,303,217

[45] Dec. 1, 1981

[54] PEGBOARD STABILIZER

[75] Inventor: Benjamin L. Garfinkle, Alameda, Calif.

[73] Assignee: Clamp Swing Pricing Co., Alameda, Calif.

[21] Appl. No.: 89,034

[22] Filed: Oct. 29, 1979

[51] Int. Cl.[3] ..... E04G 5/06

[52] U.S. Cl. ..... 248/221.1

[58] Field of Search ..... 248/221.1, 220.4, 221.2, 248/220.3, 223.3, 224.4, 225.2; 211/192, 59.1

[56] References Cited

U.S. PATENT DOCUMENTS

| | | | |
|---|---|---|---|
| 3,193,231 | 7/1965 | Curry | 248/221.1 |
| 3,244,390 | 4/1966 | Kerr | 248/220.4 |
| 3,319,917 | 5/1967 | Bilodeau | 248/221.2 |
| 3,477,677 | 11/1969 | Hindley | 248/220.3 |
| 3,591,117 | 7/1971 | Mazzetti | 248/221.2 |
| 3,664,625 | 5/1972 | Price | 248/221.2 |
| 3,879,006 | 4/1975 | Staudte | 248/221.2 |
| 3,941,343 | 3/1976 | Kennedy | 248/220.3 |
| 4,105,179 | 8/1978 | Elliott | 248/221.2 |

FOREIGN PATENT DOCUMENTS

| | | | |
|---|---|---|---|
| 243613 | 10/1962 | Australia | 248/221.2 |

*Primary Examiner*—J. Franklin Foss

*Attorney, Agent, or Firm*—Limbach, Limbach & Sutton

[57] ABSTRACT

A stabilizer for use with pegboard hangers of the type having a hook back plate is disclosed. The stabilizer comprises a body section capable of contacting one surface of the back plate and a first protrusion perpendicularly emanating from said body section adapted to snugly fit into a pegboard hole together with a hook member. A second protrusion is optionally located perpendicularly emanating from the body section adapted to engage the back plate.

8 Claims, 6 Drawing Figures

PEGBOARD STABILIZER

BACKGROUND OF THE INVENTION

Figure 1A:
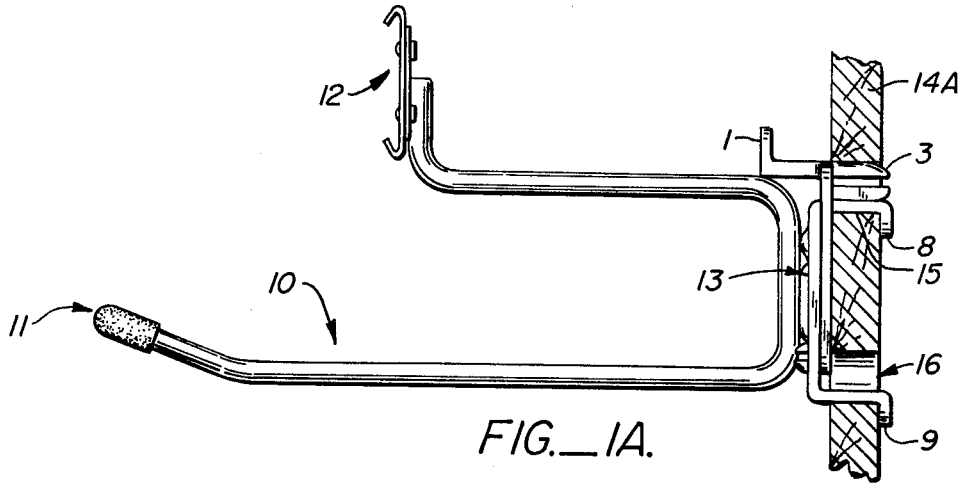

Article supporting racks are commonly provided by the use of relatively rigid sheets of pegboard or the like perforated in a regular grid-like pattern so that supporting hangers in the form of hooks or brackets may be secured in various locations on the board by engaging an anchoring element of the hanger with a selected perforation in the board. Hangers for such use with pegboard take many different forms and shapes which are determined primarily by the nature of the articles that are to be supported thereby. Some of the most stable configurations are of the type where a rigid, vertical back plate having a hook for insertion within openings in the pegboard support horizontally extending article-supporting members. Within that broad description, article supporting members having a multi-hook back plate are even more rigid. For example, a dual-hook back plate having side by side hook members provide improved stability against horizontally applied forces being placed upon the load bearing member while dual-hook back plates having a first hook located above the second improves the stability of the assembly for the top hook provides a load bearing member for those items placed upon the hanger, while the lower hook helps to prevent the hanger assembly from being inadvertently lifted from the pegboard by an upward force. A four hook assembly combines both the horizontal and vertical stability of each type of dual-hook back plate hanger.

Although a hooked back plate support is most rigid and a multi-hook support provides an extended degree of stability for pegboard hangers, it was nevertheless found that such hangers would often times lift from the pegboard by someone accidentally disturbing the hangers. Many times store personnel which use such hangers to display merchandise would, upon lifting merchandise from the support, inadvertently lift the pegboard hanger causing the hooks to be lifted from the pegboard openings resulting in the entire hanger assembly falling from the pegboard support.

Others have, in the past, made various attempts to produce means for preventing pegboard hangers from being inadvertently removed from the pegboard backing. For example, U.S. Pat. No. 3,193,231 provides a storage device which is affixed to a vertical pegboard surface 11. The storage device is affixed by means of pins 14 and 18. As shown in FIGS. 6 and 7, the pins may consist of sectioned cylinders which provide a spring clipping action. This patent does not show separate stabilizer means which can be used in conjunction with presently existing pegboard hangers, although the need for some type of stabilization between hangers and pegboards was well recognized. A similar disclosure can be found in U.S. Pat. No. 3,452,954 which, again, utilizes a split peg spring action to stabilize the pegboard hanger. U.S. Pat. No. 3,037,732 does show a stabilizer for pegboard hangers which can be used on existing hangers as a means of positively stabilizing the devices. The present invention, however, is considered to be a distinct improvement over the device disclosed in U.S. Pat. No. 3,037,732 for that device, unlike the present invention which will be described hereinafter, has no positive locating means for lining up the stabilizer with a pegboard opening, requires two hands to remove the stabilizer from the pegboard, is of such a configuration as to seriously damage the pegboard opening when the stabilizer is repetitively inserted and removed and prevents the direct frontal insertion and removal of the hanger onto and from the pegboard. This latter point becomes important when using hangers of extended length, i.e., 4 inches or more, under an existing shelf or when articles are hanging above.

The stabilizing means of the present invention is capable of being used with single or multi-hook back plate hangers which have current widespread acceptance. Thus, the stabilizer of the present invention is capable of being readily adapted to currently available hanger devices. By contrast, a stabilizer is presented in U.S. Pat. No. 3,640,497, which although presenting a stabilizing means superior to others presented in the prior art, is incapable of being adapted to a dual-hook back plate device and is extremely complex as compared to the present invention.

SUMMARY OF THE INVENTION

It is an object of the present invention to provide a stabilizer for use with pegboard hangers having none of the disadvantages of prior art devices.

It is yet another object of the present invention to provide a stabilizer for use with pegboard hangers which can be easily inserted and removed from a pegboard panel without undue effort and without harming said panel.

These and other objects of the present invention are accomplished by providing a stabilizer for use with pegboard hangers of the type having a hook back plate which comprises a body section capable of contacting one surface of the back plate and a first protrusion perpendicularly emanating from said body section adapted to snugly fit into a pegboard hole together with a hook member. Optionally, the stabilizer can possess a second protrusion perpendicularly emanating from its body section adapted to engage the back plate. As further preferred embodiments, both the first and second protrusions are of a split lug configuration, the second protrusion being configured to frictionally engage an opening in the back plate and to lock within that opening. This prevents the stabilizers from being inadvertently lost or misplaced during ordinary usage. The stabilizer can also possess, as yet a further preferred embodiment, tab means emanating from the body section proximate to the first protrusion to aid in the removal of the stabilizer from the pegboard.

The pegboard stabilizer of the present invention can also be formed as an integral part of a hook back plate member. Thus, when new hook back plate hanger assemblies are constructed, they can be formed having stabilizer protrusions emanating from the back plate in a unitary construction.

The present invention comprises, as a separate embodiment, the unitary structure per se. The inclusion of the hanger can be done after the ultimate user has acquired the back plate-stabilizer assembly.

Figure 2A:
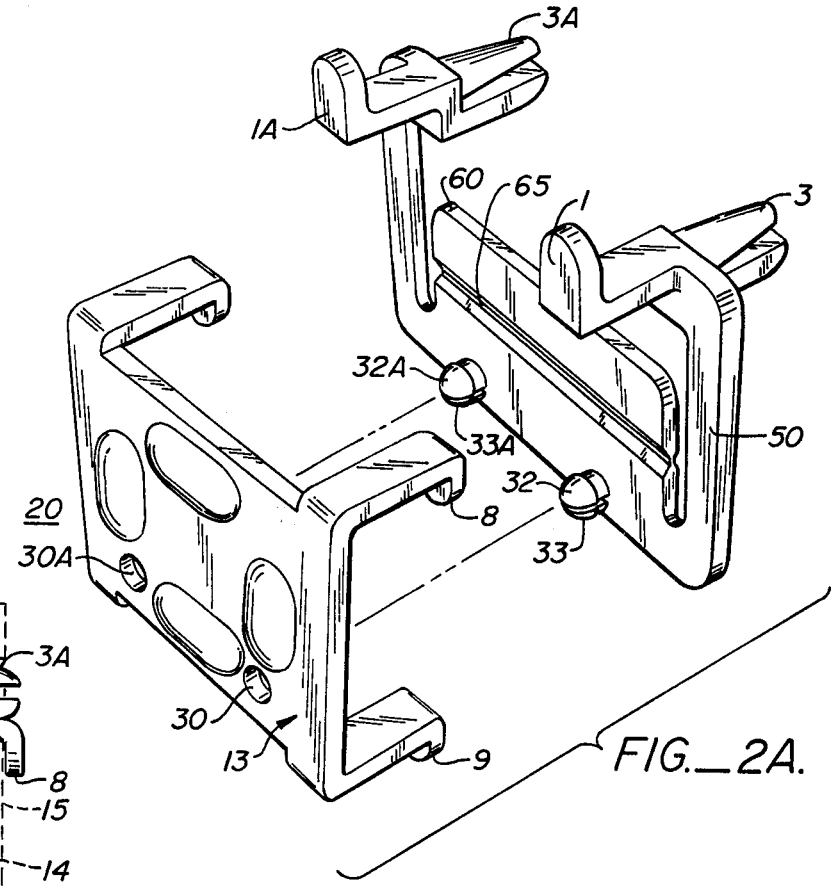
Figure 3A:
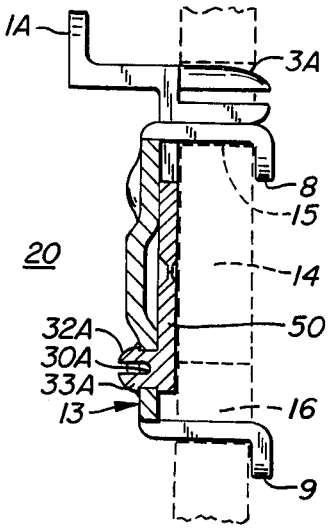
Figure 1B:
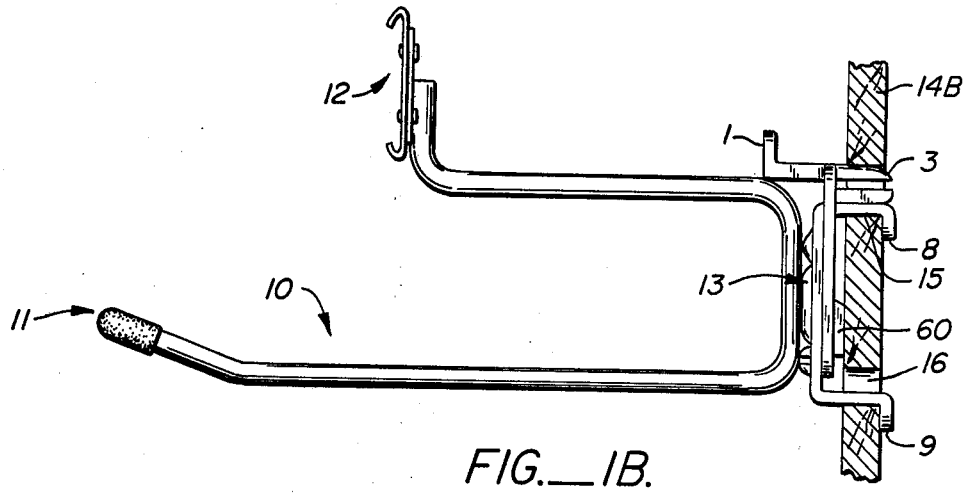
Figure 2B:
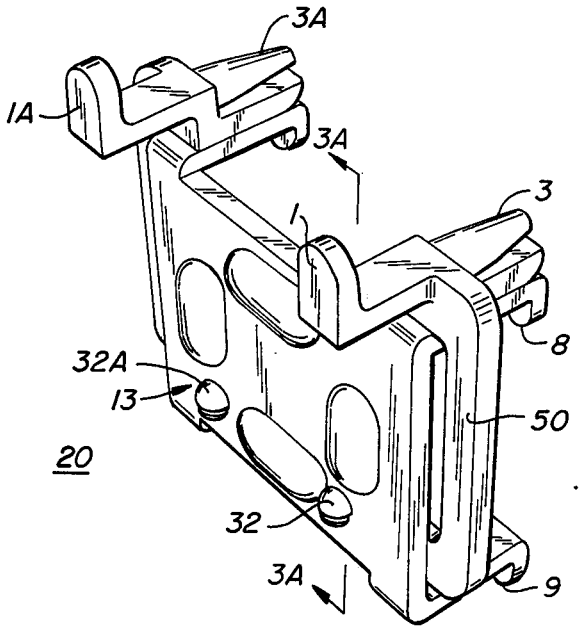
Figure 3B:
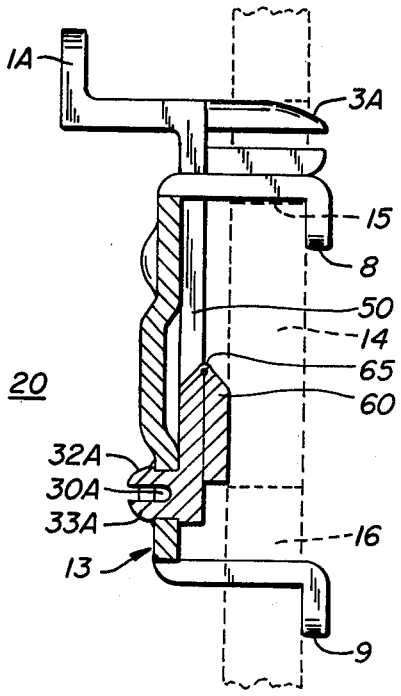

The present invention will be more fully appreciated by considering the appended drawings wherein, FIGS. 1A and 1B are side views of the stabilizer of the present invention used with a multi-hook back plate hanger;

FIGS. 2A and 2B are perspective views of the preferred configuration of the stabilizer of the present invention; and FIGS. 3A and 3B are side views of the stabilizer of FIG. 2 being engaged with a pegboard panel and a multi-hook back plate.

FIGS. 1A and 1B show a conventional multi-hook back plate hanger device which supports a hanger which, for the purpose of this illustration, is comprised of a single rod 10, which is bent to support safety tip 11 and price tag holder 12. The hanger is connected to pegboard panel 14 by a multi-hook back plate 13, which possesses hooks 8 and 9 for engagement with adjacent pegboard openings 15 and 16.

Although the hanger of FIGS. 1A and 1B represents a reasonably stable structure, it is nevertheless capable of being inadvertently removed from the hanger structure. This occurs many times in a commercial setting when a consumer wishes to remove merchandise from the hanger and instead of pulling the merchandise from the hanger past safety tip 11, merely lifts up upon the merchandise causing disengagement between the entire hanger assembly and the pegboard panel.

The present invention comprises stabilizer 20, which can be described as possessing a body section 50 capable of contacting one surface of back plate 13. First protrusions 3, 3A protrude perpendicularly from body section 50 and are adapted to snugly fit into pegboard hole 15 as shown in FIGS. 3A and 3B. The stabilizer of the present invention is capable of being easily inserted within pegboard hole 15 and will result in preventing the hanger assembly from being removed from the pegboard inadvertently. Also, the stabilizer can be readily removed from engagement with the pegboard and hanger by merely placing finger pressure behind tabs 1, 1A which are ideally located proximate to the first protrusions 3, 3A, respectively. Thus, it is a specific design feature of the present invention to present a stabilizing member which can easily be inserted and removed from its stabilizing engagement with the pegboard panel and hanger.

As an optional preferred embodiment, the stabilizer of the present invention is further configured to possess second protrusions 32, 32A which perpendicularly emanate from body section 50 for engagement with back plate 13. Ideally, protrusions 32, 32A are also of a split lug configuration having enlarged head portions 33, 33A, which are intended to frictionally engage openings 30, 30A in the back plate and to, once engaged, lock within that opening. As can be readily visualized, when stabilizer 20 is formed as a unitary element with the back plate, there is no necessity for including protrusions 32 and 33 and the complementary openings 30, 30A.

From the above discussion, it should be quite evident that applicant has presented an inexpensive straightforward approach to stabilizing hangers of the type having a hook back plate which are inexpensive to fabricate and easy to use. The stabilizer of the present invention can be fabricated of plastic or metal and, once fabricated, should last indefinitely.

When not of a unitary structure, the only adaptation of current hook back plate members which is required to use the stabilizer of the present invention is the formation of holes 30, 30A for acceptance of the second protrusions. Once this is accomplished, the present stabilizer greatly improves the stability of multi-hook back plate-pegboard systems which are characterized as being quite convenient to use and virtually impossible to lose. First protrusions 3, 3A are easily inserted into the pegboard openings and are easily removed via tabs 1, 1A. By use of the lower protrusions, the stabilizer members remain with the back plate even when the assembly is removed from the pegboard backing.

Standard pegboards are generally of ¼ inch or 3/16 inch in thickness. If the combination stabilizer back plate assemblies are constructed for ¼ inch pegboard, its use on 3/16 inch pegboard would result in a less than snug fit. To compensate for this eventuality, the present invention, as a further optional preferred embodiment, is constructed to possess gap flap 60. In FIGS. 1A, 2A and 3A, the gap flap 60 and body section 50 form a single plane which adapts the present invention for use with ¼ inch pegboard. However, in FIGS. 1B, 2B and 3B, gap flap 60 is bent along hinge 65 for use with 3/16 inch pegboard. It should be noted that the gap flap effectively compensates for the thinner 3/16 inch pegboard to facilitate a snug fit between hook members 8, 9, pegboard 14, and body section 50.

For purposes of illustration, applicant has shown the present invention with a dual hook back plate. It should be noted, however, that a single hook back plate or a multi-hook member can be employed with the present stabilizer while remaining within the scope of the claimed invention.

What is claimed is:

1. A stabilizer for use with pegboard hangers of the type having a hook back plate, said stabilizer comprising a body section capable of contacting one surface of said back plate, a first protrusion perpendicular to said body section of such size and shape to snugly fit into a pegboard hole together with a hook member of said back plate, and a second protrusion perpendicular and on the opposite side of the body section as the first protrusion to snugly fit in a receiving hole in the back plate.

2. The stabilizer of claim 1 which further comprises a tab emanating from said body section proximate to said first protrusion to aid in removal of the stabilizer from the pegboard.

3. The stabilizer of claim 1 further comprising a gap flap for snugly engaging said body section and back plate with said pegboard when said pegboard is 3/16 inch in thickness and which forms a unitary plane with the body section when the pegboard is ¼ inch in thickness.

4. The stabilizer of claim 1 wherein said first protrusion is of a split lug configuration.

5. The stabilizer of claim 1 wherein said second protrusion is of a split lug configuration.

6. The stabilizer of claim 1 wherein said second protrusion is configured to frictionally engage an opening in the back plate and to lock within that opening.

7. The stabilizer of claim 1 wherein the pegboard hanger is of the type having a dual hook back plate.

8. The stabilizer of claim 1 wherein the pegboard hanger is of the type having a four hook back plate.

* * * * *